US011649141B2

(12) United States Patent
Jin et al.

(10) Patent No.: US 11,649,141 B2
(45) Date of Patent: May 16, 2023

(54) BUFFER STOP USED FOR END OF CRANE RAILS

(71) Applicant: SOUTHEAST UNIVERSITY, Jiangsu (CN)

(72) Inventors: Hui Jin, Jiangsu (CN); Haihan Jiao, Jiangsu (CN); Keqin Ding, Jiangsu (CN); Libin Wang, Jiangsu (CN)

(73) Assignee: SOUTHEAST UNIVERSITY, Jiangsu (CN)

( * ) Notice: Subject to any disclaimer, the term of this patent is extended or adjusted under 35 U.S.C. 154(b) by 238 days.

(21) Appl. No.: 17/323,291

(22) Filed: May 18, 2021

(65) Prior Publication Data

US 2022/0024728 A1 Jan. 27, 2022

(30) Foreign Application Priority Data

Jul. 23, 2020 (CN) ..... 202010717187.2

(51) Int. Cl.
*B66C 7/16* (2006.01)
*B61K 7/20* (2006.01)

(52) U.S. Cl.
CPC . *B66C 7/16* (2013.01); *B61K 7/20* (2013.01)

(58) Field of Classification Search
CPC .... B66C 7/16; B66C 9/16; B66C 9/18; B66C 11/26; B66C 13/00; E01B 23/10; E01B 26/00; B61K 7/16; B61K 7/18; B61K 7/20
See application file for complete search history.

(56) References Cited

U.S. PATENT DOCUMENTS 4,216,724 A * 8/1980 Grillet ..... B61K 7/20 104/258
6,155,178 A * 12/2000 Pease ..... B61K 7/20 104/258
9,260,120 B2 * 2/2016 Opelt ..... B61K 7/20
2022/0024729 A1 * 1/2022 Jin ..... B61K 7/20

FOREIGN PATENT DOCUMENTS

CN 2458269 Y 11/2001
CN 2575075 Y * 9/2003 ..... B66C 7/16
CN 2575075 Y 9/2003

(Continued)

*Primary Examiner* — Zachary L Kuhfuss
*Assistant Examiner* — Cheng Lin
(74) *Attorney, Agent, or Firm* — Muncy, Geissler, Olds & Lowe, P.C.

(57) ABSTRACT

The present invention provides a buffer stop used for an end of crane rails, including: a rail fastener fixedly connected to the crane rails, where a sliding rail is provided on each side of the rail fastener, a sliding shaft passes through the sliding rails and connecting brackets are mounted at two ends of the sliding shaft, an other end of the connecting bracket is connected to an arc-shaped plate above the rail fastener, each outer side of the connecting brackets is connected to a drive rod B by the sliding shaft, each drive rod B is connected to a drive rod A by a rotating shaft, an impact shaft is connected between top portions of two drive rods A, an impact rubber is mounted on one side of the impact shaft facing crane wheels, and each drive rod A is connected to the rail fastener by a pin shaft. The present invention is used for braking the crane at the end of the rails, to ensure safety of the crane.

4 Claims, 9 Drawing Sheets

(56) References Cited

FOREIGN PATENT DOCUMENTS

| | | | | | |
|---|---|---|---|---|---|
| CN | 2797319 | Y | | 7/2006 | |
| CN | 201184388 | Y | * | 1/2009 | ..... F16F 15/04 |
| CN | 106222396 | A | * | 12/2016 | ..... C21D 9/70 |
| CN | 106222396 | A | | 12/2016 | |
| CN | 104671085 | B | * | 1/2017 | ..... B66C 9/16 |
| CN | 108726384 | A | | 11/2018 | |
| CN | 109650253 | A | * | 4/2019 | ..... B66C 7/16 |
| KR | 100784618 | B1 | * | 12/2007 | ..... B66C 9/16 |
| SU | 1062174 | A1 | * | 12/1983 | ..... B66C 7/16 |
| SU | 1062174 | A1 | | 12/1983 | |

* cited by examiner

BUFFER STOP USED FOR END OF CRANE RAILS

BACKGROUND

Technical Field

The present invention relates to the technical field of crane rail braking, and in particular, to a buffer stop used for an end of crane rails.

Related Art

As an indispensable device in industrial production, a crane has characteristics such as a large size, a large weight, and a high operating speed. Therefore, the crane requires a long braking distance, and braking of the crane at an end of rails causes some security risks. To resolve the braking problem of the crane, various buffer stops have been created. These buffer stops have a positive effect on safe braking of the crane.

Existing braking methods mainly include devices such as a brake shoe, a wheel stopper, and a rail clamp. The brake shoe performs braking on the crane wheels by increasing friction between the crane wheels and the rails, but a center of gravity of the crane wheels is raised during braking, which is prone to overturning. The wheel stopper performs braking by increasing operating friction drag of the crane wheels, but the wheel stopper has to be used in conjunction with a hydraulic mechanism, and costs are relatively high. The rail clamp implements a braking effect by increasing sliding resistance between the crane wheels and the rails, but the braking effect is not obvious due to a small contact surface.

In all the braking methods of the foregoing devices, operating of the crane wheels is changed from rolling to sliding, to further increase friction drag to achieve the braking effect. Therefore, a longer braking area needs to be provided for the braking of the crane wheels. Construction costs are increased, and emergency braking cannot be implemented within a short distance for a short time.

SUMMARY

In view of the foregoing existing problems, the present invention provides a buffer stop used for an end of crane rails. Compared with the previous braking devices for the crane, the buffer stop does not diminish energy through friction. Instead, the buffer stop uses a damping sheet to diminish energy generated during braking of the crane wheels, which requires a short braking distance and rapidly achieves braking. In addition, the buffer stop may be mounted at the end of the crane rails in advance, is easy to manufacture and mount, and has a long service life, thereby ensuring the safety of the crane.

To achieve the foregoing objective, the technical solution of the present invention is as follows: a buffer stop used for an end of crane rails is provided and includes: a rail fastener fixedly connected to the crane rails, where a sliding rail is provided on each side of the rail fastener, a sliding shaft passes through the sliding rails and connecting brackets are mounted at two ends of the sliding shaft, an other end of the connecting bracket is connected to an arc-shaped plate above the rail fastener, each outer side of the connecting brackets is connected to a drive rod B by the sliding shaft, each drive rod B is connected to a drive rod A by a rotating shaft, an impact shaft is connected between top portions of two drive rods A, an impact rubber is mounted on one side of the impact shaft facing crane wheels, and each drive rod A is connected to the rail fastener by a pin shaft.

Based on the buffer stop used for an end of crane rails, the connecting brackets are two L-shaped steel brackets mounted on both sides of the rail, the connecting bracket is connected to the drive rod B by the sliding shaft clamped on the sliding rail, a rear baffle is fixed between the two connecting brackets, and a damping sheet is pasted on a face of the rear baffle facing the crane wheels.

Based on the buffer stop used for an end of crane rails, a front baffle is fixed at an upper end of the rail fastener, the front baffle is provided opposite the rear baffle, a damping sheet is pasted on a face of the front baffle facing away from the crane wheels, and there is a gap between the damping sheet on the front baffle and the damping sheet on the rear baffle.

Based on the buffer stop used for an end of crane rails, the rail fastener is a U-shaped steel fastener fixed at the end of the crane rails by using bolts, and a sliding groove for passage of the crane wheels is provided at an upper end on a side of the rail fastener close to the crane wheels.

Beneficial Effects:

Compared with the conventional connection solution, in the present invention, the crane wheels are braked by converting kinetic energy of the crane into elastic potential energy through the damping sheet, achieving a good buffer braking effect, and the required braking distance is short, achieving emergency braking; the braking of the crane wheels does not rely on the friction between the rails and the crane wheels, and does not affect the service life of the rails and the crane wheels; and the center of gravity of the crane wheels is always at the same height when braking, which does not cause the crane to overturn. The entire buffer stop has a simple structure, is easy to process and mount, and has a long service life. After the braking is completed, the buffer stop can return to a former state automatically without a need of manual mechanical assistance. Therefore, the buffer stop has a broad application prospect.

DETAILED DESCRIPTION

Figure 1:
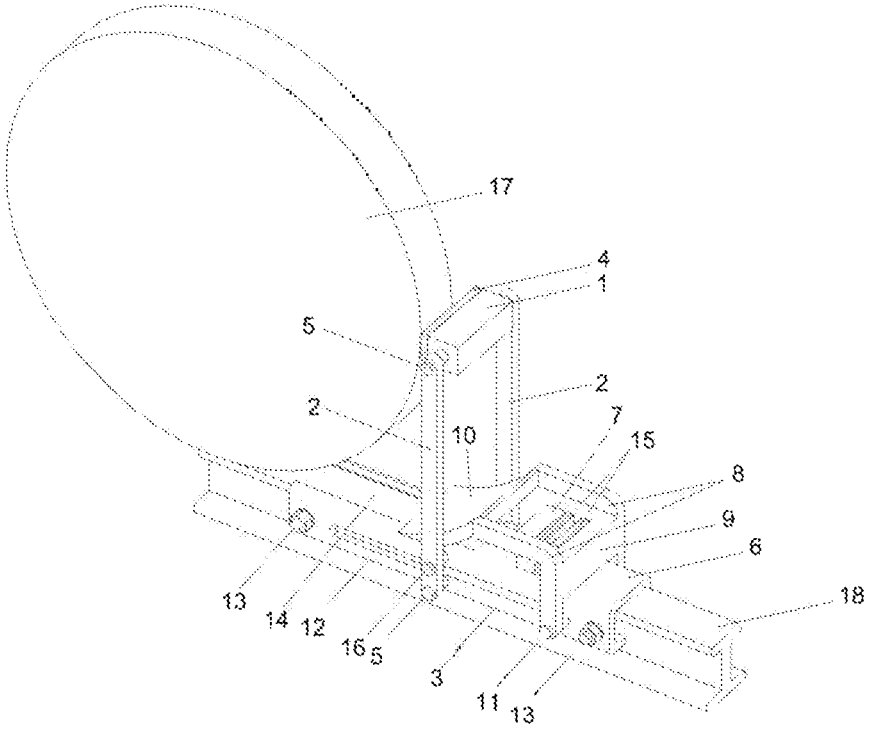
FIG. 1 is a schematic diagram of an overall structure of a buffer stop according to the present invention.

The following clearly and completely describes the technical solutions in the embodiments of the present invention. The described embodiments are some but not all of the embodiments of the present invention. All other embodiments obtained by a related person in the art based on the embodiments of the present invention without creative efforts shall fall within the protection scope of the present invention.

Referring to FIG. 1 to FIG. 9, a buffer stop of the present invention is mounted at an end of a rail 18, and has a main function of braking a crane wheel 17 when the crane wheel 17 quickly moves to the end of the rail 18. An impact shaft 1, a drive rod A 2, and a drive rod B 3 are connected by a rotating shaft 5. The drive rod A 2 is also connected to a rail fastener by a pin shaft 16, an other end of the drive rod B 3 is connected to a connecting bracket 8 by a sliding shaft 11 clamped on a sliding rail 12, a rear baffle 9 is fixed between the connecting brackets 8, and an arc-shaped plate 10 is fixed at a front end of the connecting brackets 8. The rail fastener 6 is fixed at the end of the crane rail 18 through bolts 13, and a front baffle 7 is fixed on the rail fastener.

The impact shaft 1 is a rectangular steel shaft of which the main function is to take the impact of the crane wheel 17.

An impact rubber 4 is located on a side of the impact shaft 1 that takes the impact and is made of cushioning rubber, and is intended to avoid damage to the impact shaft 1 caused by excessive impact of the crane wheel 17.

The drive rods A 2 and the drive rods B 3 are long steel rods and located on both sides of the crane rail 18, and the drive rods A 2 and the drive rods B 3 each includes two rods, of which the main function is to transmit power of the crane wheel 17 taken by the impact shaft 1, and to drive, when the crane wheel 17 impacts the impact shaft 1, the rear baffle 9 to move toward the crane wheel 17.

The rotating shaft 5 is a round steel shaft, and has a main function of connecting a force-bearing member and a force transmission member, so that the impact shaft 1, the drive rod A 2, and the drive rod B 3 can rotate around the rotating shaft 5, but cannot detach from the rotating shaft 5.

The rail fastener 6 is a U-shaped steel fastener, is fixed at the end of the crane rail 18 through the bolts 13, and has a main function of fixing the entire buffer stop at the end of the crane rail 18.

A sliding groove 14 is provided at an upper end on a side of the rail fastener 6 close to the crane wheel 17, and has a main function of facilitating passage of the crane wheel 17, so that a center of gravity of the crane wheel 17 does not rise when the crane wheel 17 passes.

The sliding rails 12 are provided on both sides of the rail fastener 6, and each sliding rail is a long hollow sliding groove and has a main function of enabling the connecting bracket 8 to only slide back and forth on the rail fastener 6 along a traveling direction of the crane wheel 17 and to be unable to detach from the crane rail 18.

The sliding shaft 11 is a round steel shaft and has a main function of fixing the drive rods B 3 and the connecting brackets 8 on both sides of the rail fastener 6, so that an end of the drive rod B 3 and the connecting bracket 8 can only move back and forth along a traveling direction of the crane wheel 17, but cannot detach from the rail fastener 6.

The pin shaft 16 is a round steel shaft and has a main function of fixing the drive rod A 2, so that the drive rods A 2 can only rotate around the pin shaft 16 and keep a relatively fixed height on both sides of the rail fastener 6.

The front baffle 7 is fixed at an upper end of the rail fastener 6 and is a square steel plate. A damping sheet 15 is pasted on a face of the front baffle 7 facing away from the crane wheel 17, and has a main function of diminishing energy generated due to the braking of the crane wheel 17.

The connecting brackets 8 are two L-shaped steel brackets mounted on both sides of the crane rail 18. The connecting bracket 8 is connected to the drive rod B 3 by the sliding shaft 11 clamped on the sliding rail 12, and has a main function of transmitting kinetic energy generated due to the braking of the crane wheel 17 and driving the rear baffle 9 and the arc-shaped plate 10 to move.

The rear baffle 9 is fixed between the connecting brackets 8 and is a square steel plate. A damping sheet 15 is pasted on a face of the rear baffle 9 facing the crane wheel 17, and has a main function of diminishing energy generated due to the braking of the crane wheel 17.

The arc-shaped plate 10 is fixed at a front end of the connecting bracket 8 and is not in contact with the rail fastener 6. The arc-shaped plate 10 is an arc-shaped steel plate made of energy-diminishing mild steel, and is configured to come into contact with the crane wheel 17 and implement braking in conjunction with the damping sheet 15.

The following describes a mounting method of the present invention in detail with reference to FIG. 4 to FIG. 7:

1. All members of the present invention can be prefabricated in the factory, and only need to be processed and assembled on site. The damping sheet used in the present invention is an existing industrialized product, and may be selected according to needs during mounting. All members need to undergo quality inspection before delivery.

2. The impact rubber 4 is pasted, in advance, on a side of the impact shaft 1 that takes the impact. Both ends of the impact shaft 1 are connected to an end of the drive rod A 2 by the rotating shaft 5. After the connection is completed, an other end of the drive rod A 2 is connected to an end of the drive rod B 3 by the rotating shaft 5, and the drive rod A 2 is connected to an outer side of the rail fastener by the pin shaft 16, so that the drive rod A 2 can only rotate around the pin shaft under force, but cannot detach from the pin shaft.

3. The sliding groove 14 and the sliding rail 12 are provided on the rail fastener 6 in advance, the sliding shaft 11 is clamped into the sliding rail 12 in advance, and the front baffle 7 is welded at the middle of the rail fastener 6 in advance. The arc-shaped plate is welded to the front end of the connecting bracket 8 in advance, and the rear baffle 9 is welded between the two connecting brackets 8 in advance. The damping sheets 15 are pasted on corresponding positions of the front baffle 7 and the rear baffle 9 in advance. The connecting bracket 8 is connected to the rail fastener 6 by the sliding shaft 11, and the rail fastener 6 is fixed at the end of the crane rail 18 through the bolts 13.

4. An unconnected end of the drive rod B 3 is connected to the rail fastener 6 by the sliding shaft 11, and in this way, the mounting of the entire device is completed.

The following describes a braking principle of the present invention in detail with reference to FIG. 1, FIG. 2, FIG. 8, and FIG. 9.

Figure 2:
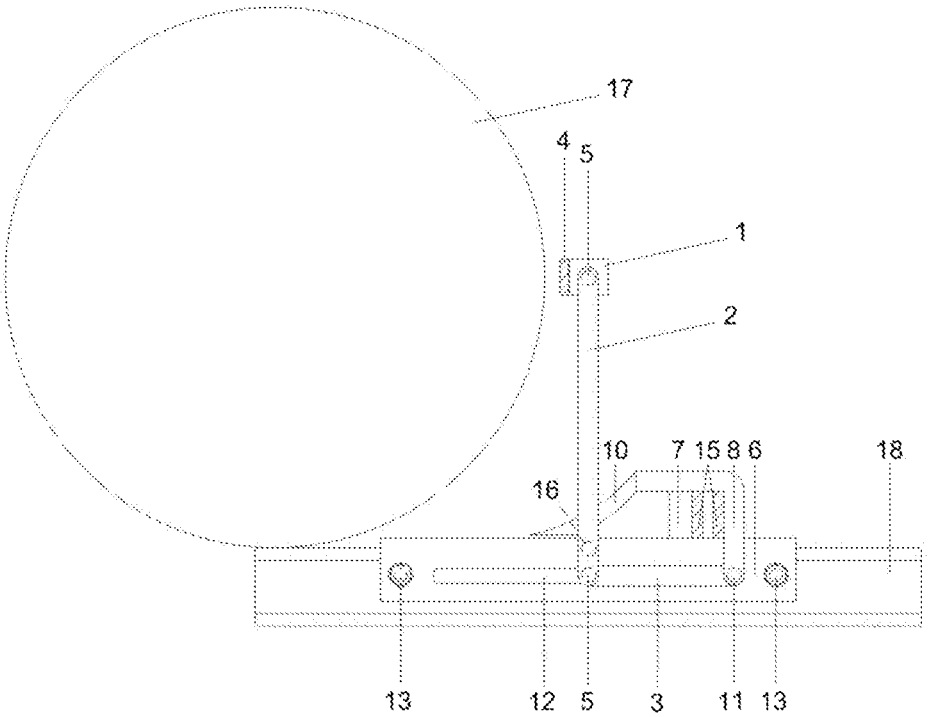
FIG. 2 is a front view of an overall structure of a buffer stop according to the present invention.
Figure 3:
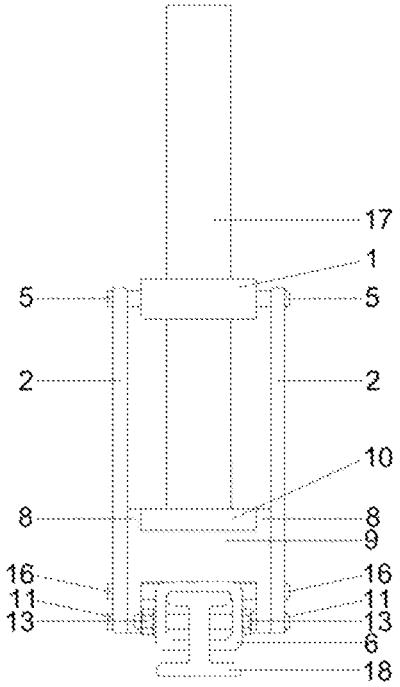
FIG. 3 is a side view of an overall structure of a buffer stop according to the present invention.
Figure 4:
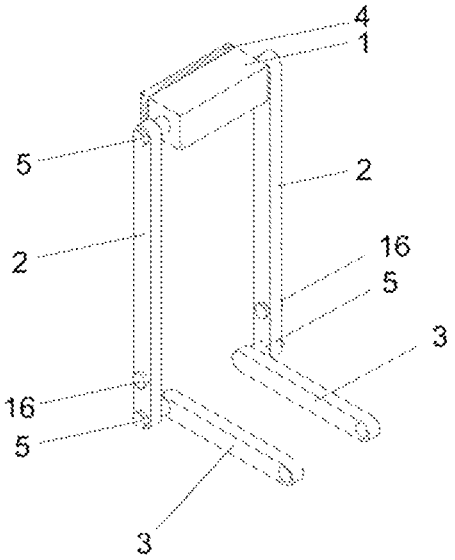
FIG. 4 is a schematic diagram of a drive rod A, a drive rod B, and an impact shaft of a buffer stop according to the present invention.
Figure 5:
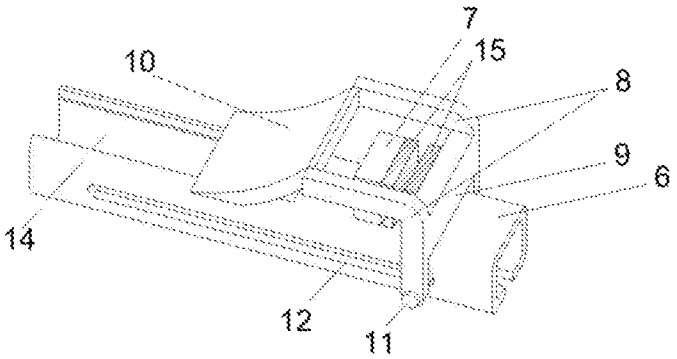
FIG. 5 is a schematic diagram of a rail fastener, connecting brackets, a front baffle, a rear baffle, and an arc-shaped plate of a buffer stop according to the present invention.
Figure 6:
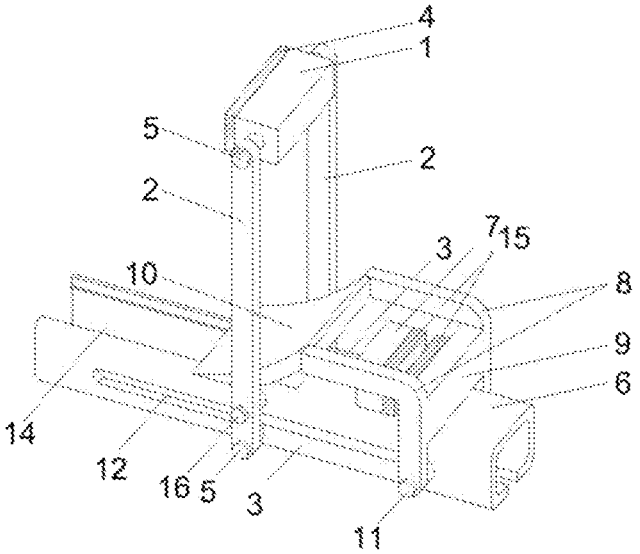
FIG. 6 is a schematic diagram of an overall device of a buffer stop according to the present invention.
Figure 7:
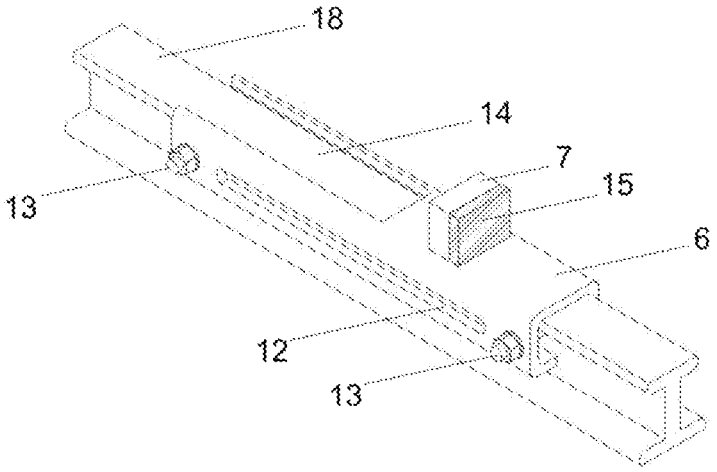
FIG. 7 is a schematic diagram of a rail fastener and a front baffle of a buffer stop according to the present invention.
Figure 8:
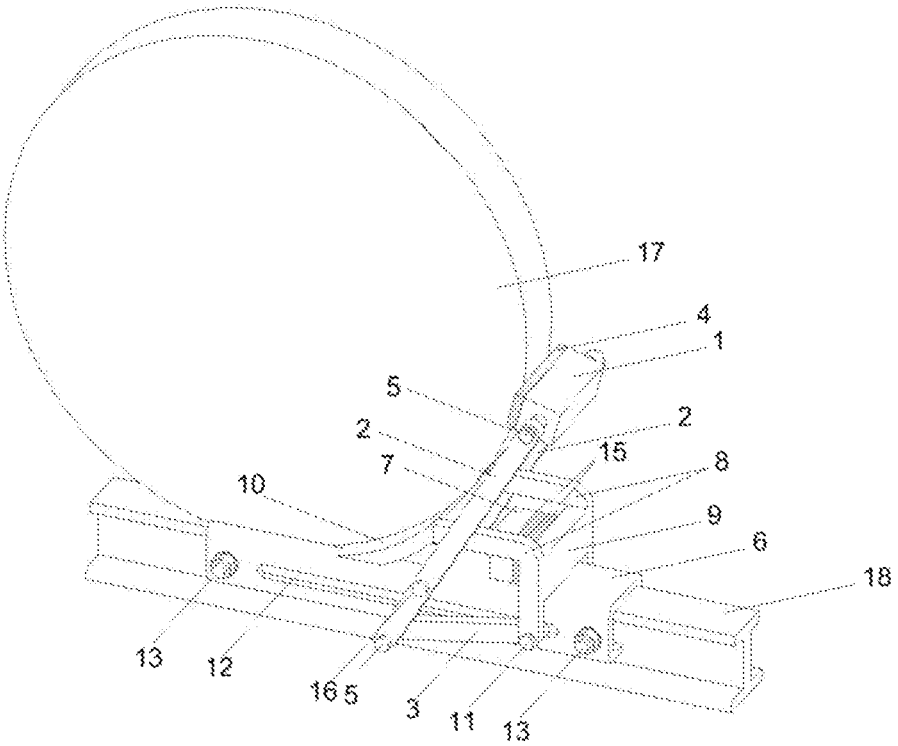
FIG. 8 is a schematic diagram of a buffer stop after braking according to the present invention.
Figure 9:
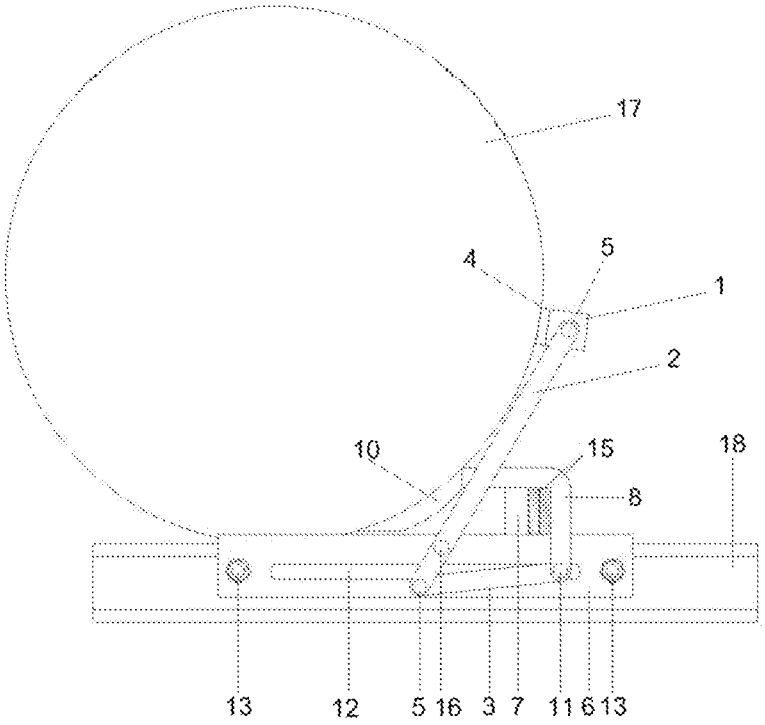
FIG. 9 is a front view of a buffer stop after braking according to the present invention; and in the figures, 1 represents an impact shaft, 2 represents a drive rod A, 3 represents a drive rod B, 4 represents an impact rubber, 5 represents a rotating shaft, 6 represents a rail fastener, 7 represents a front baffle, 8 represents a connecting bracket, 9 represents a rear baffle, 10 represents an arc-shaped plate, 11 represents a sliding shaft, 12 represents a sliding rail, 13 represents a bolt, 14 represents a sliding groove, 15 represents a damping sheet, 16 represents a pin shaft, 17 represents a crane wheel, and 18 represents a rail.

1. As shown in FIG. 1 and FIG. 2, in a normal case, under a joint action of the pin shaft 16, the connecting bracket driven by the drive rod B 3, and the arc-shaped plate, the drive rod A 2 is in a vertical state, the drive rod B 3 is in a horizontal state, and the sliding shaft 11 is located at an end of the sliding rail 12 away from the crane wheel 17, the damping sheets 15 pasted on the front baffle 7 and the rear baffle 9 are not in contact with each other, and the entire structure is in a static state.

When the crane wheel 17 travels to the end of the crane rail 18, the crane wheel touches the impact rubber 4 pasted on the impact shaft 1, driving the impact shaft 1 to move in a traveling direction of the crane wheel 17, the impact shaft 1 drives, through the rotating shaft 5, the drive rod A 2 and the drive rod B 3 to rotate, and the drive rod B 3 drives, through the sliding shaft 11, the connecting bracket 8 to move toward the crane wheel 17. The damping sheets 15 pasted on the front baffle 7 and the rear baffle 9 are in contact with each other, to convert kinetic energy generated due to the braking of the crane wheel 17 into elastic energy of deformation of the damping sheets 15. In addition, the arc-shaped plate at the front end of the connecting bracket 8 is in contact with the crane wheel 17 and performs a braking action in conjunction with the damping plates 15. In this way, the entire buffer braking process is completed.

In the foregoing specific operation methods, the technical solutions and benefits of the present invention are further described in detail. It should be understood that the foregoing descriptions are specific implementations of the present invention. Any modification, equivalent replacement, or improvement made without departing from the spirit and principle of the present invention should fall within the protection scope of the present invention.

What is claimed is:

1. A buffer stop used for an end of crane rails, comprising: a rail fastener fixedly connected to the crane rails, wherein a sliding rail is provided on each side of the rail fastener, a sliding shaft passes through the sliding rails and connecting brackets are mounted at two ends of the sliding shaft, an other end of the connecting bracket is connected to an arc-shaped plate above the rail fastener, each outer side of the connecting brackets is connected to a drive rod B by the sliding shaft, each drive rod B is connected to a drive rod A by a rotating shaft, an impact shaft is connected between top portions of two drive rods A, an impact rubber is mounted on one side of the impact shaft facing crane wheels, and each drive rod A is connected to the rail fastener by a pin shaft.

2. The buffer stop used for an end of crane rails according to claim 1, wherein the connecting brackets are two L-shaped steel brackets mounted on both sides of the rail, the connecting bracket is connected to the drive rod B by the sliding shaft clamped on the sliding rail, a rear baffle is fixed between the two connecting brackets, and a damping sheet is pasted on a face of the rear baffle facing the crane wheels.

3. The buffer stop used for an end of crane rails according to claim 1, wherein a front baffle is fixed at an upper end of the rail fastener, the front baffle is provided opposite a rear baffle, a damping sheet is pasted on a face of the front baffle facing away from the crane wheels, and there is a gap between the damping sheet on the front baffle and the damping sheet on the rear baffle.

4. The buffer stop used for an end of crane rails according to claim 1, wherein the rail fastener is a U-shaped steel fastener fixed at the end of the crane rails by using bolts, and a sliding groove for passage of the crane wheels is provided at an upper end on a side of the rail fastener close to the crane wheels.

* * * * *